US010099350B2

(12) United States Patent
Gates et al.

(10) Patent No.: US 10,099,350 B2
(45) Date of Patent: Oct. 16, 2018

(54) ROTARY TOOL

(71) Applicant: Raytheon Company, Waltham, MA (US)

(72) Inventors: Matthew R. Gates, Milford, MA (US); Rolland Stpierre, Seeknok, MA (US); Ryan William Carley, Milford, MA (US)

(73) Assignee: Raytheon Company, Waltham, MA (US)

( * ) Notice: Subject to any disclaimer, the term of this patent is extended or adjusted under 35 U.S.C. 154(b) by 4 days.

(21) Appl. No.: 15/139,153

(22) Filed: Apr. 26, 2016

(65) Prior Publication Data

US 2016/0318159 A1 Nov. 3, 2016

Related U.S. Application Data

(60) Provisional application No. 62/156,100, filed on May 1, 2015.

(51) Int. Cl.

| | |
|---|---|
| ***B25B 17/00*** | (2006.01) |
| ***B25B 13/48*** | (2006.01) |
| ***B25B 17/02*** | (2006.01) |

(52) U.S. Cl.

CPC ..... *B25B 13/48* (2013.01); *B25B 17/00* (2013.01); *B25B 17/02* (2013.01)

(58) Field of Classification Search

USPC ..... 81/57.22, 57.3, 177.8

See application file for complete search history.

(56) References Cited

U.S. PATENT DOCUMENTS

| | | | | |
|---|---|---|---|---|
| 2,574,212 | A | 11/1951 | Huss | |
| 2,830,479 | A * | 4/1958 | Finn | B25B 17/00 74/384 |
| 5,218,758 | A | 6/1993 | Nguyen | |
| 6,305,245 | B1 | 10/2001 | Kress | |
| 6,923,094 | B1 * | 8/2005 | Marquardt | B23Q 5/045 81/177.8 |
| 7,703,356 | B2 * | 4/2010 | Bass | B25B 13/481 81/177.8 |
| 7,971,509 | B2 | 7/2011 | Shortridge | |
| 8,322,255 | B1 | 12/2012 | Jordan et al. | |
| 8,640,572 | B2 * | 2/2014 | Chen | B25B 17/00 81/57.3 |
| 2011/0265612 | A1 | 11/2011 | Hung | |
| 2013/0047790 | A1 | 2/2013 | Shah et al. | |
| 2014/0298957 | A1 | 10/2014 | Ragner | |

* cited by examiner

*Primary Examiner* — Joseph J Hail
*Assistant Examiner* — Shantese McDonald

(57) ABSTRACT

A rotary tool is disclosed. The rotary tool can include a first arm and a second arm pivotally coupled to one another at a joint. Ends of the first and second arms are positionable at a variable distance from one another by pivoting the first and second arms at the joint. The rotary tool can also include a first rotatable driver disposed at the end of the first arm, a second rotatable driver disposed at the end of the second arm, and a third rotatable driver disposed at the joint. In addition, the rotary tool can include a drive train operably coupled to the first, second, and third rotatable drivers to transfer torque, such that an input torque applied to one of the first, second, and third rotatable drivers causes torque output at the other rotatable drivers.

21 Claims, 7 Drawing Sheets

ROTARY TOOL

RELATED APPLICATIONS

This application claims the benefit of U.S. Provisional Application Ser. No. 62/156,100, filed May 1, 2015, and entitled "Simulsocket—Multisocket Tool," which is incorporated by reference herein in its entirety.

BACKGROUND

Electrical connectors that couple to circuit boards or other such components often include mechanical fasteners, such as screws or bolts, to maintain a secure connection. Often, an electrical connector is secured to a circuit board by two or more fasteners that extend through a body or housing of the electrical connector and into mating threaded features associated with the circuit board. The fasteners typically extend through openings in the connector body that align the fasteners with the mating threaded features of the circuit board and guide the fasteners as they are advanced into or withdrawn from the mating threaded features. Technicians generally use hand tools or power tools to drive the fasteners. In many cases, these can be difficult to manipulate due to their location and/or due to the presence of partially impeding circuit board or other structure.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1A:
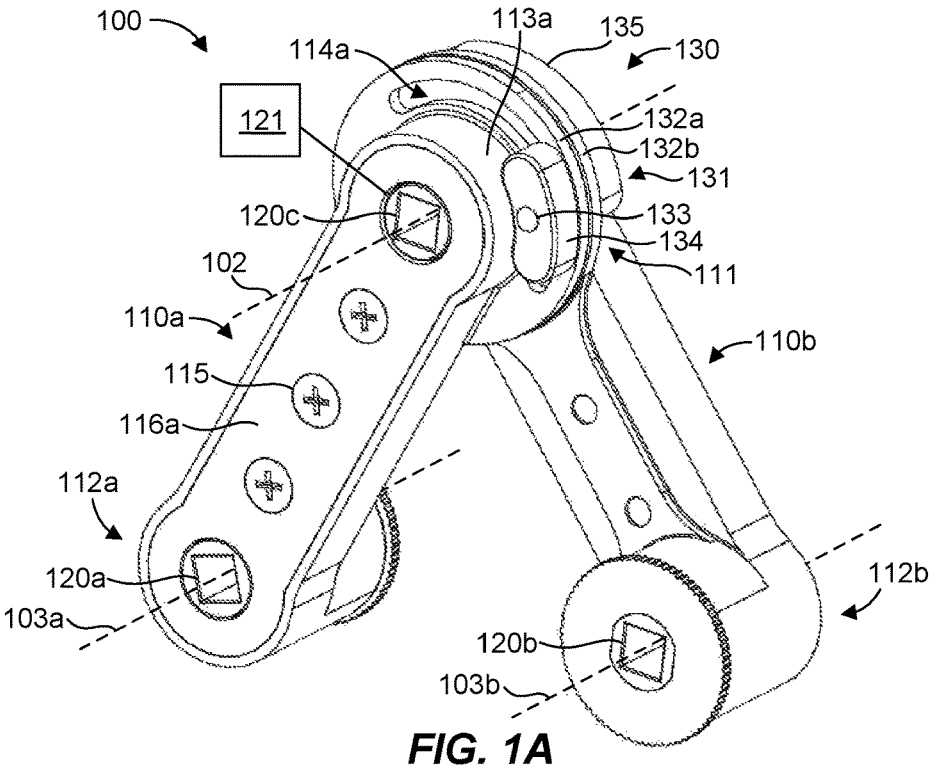
FIG. 1A is an example illustration of a rotary tool in accordance with an example of the present disclosure.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

Although typical hand tools and power tools can be effectively utilized to drive fasteners that secure electrical connectors to circuit boards, complications can arise. For example, tight-fitting openings in connector bodies can be restrictive to fastener movement within the openings. Thus, advancing or withdrawing one fastener too much relative to another fastener can cause the electrical connector to tip or rotate relative to the circuit board, which can cause the fasteners to bind within the openings. This can cause the fasteners to strip and/or the connector body to crack, which can necessitate expensive rework to repair. As a result, the fasteners must be alternately advanced or withdrawn a little at a time in order to avoid binding of the fasteners within the openings, which is tedious and time-consuming.

Accordingly, a rotary tool is disclosed that can simultaneously drive multiple fasteners. In one aspect, the rotary tool can be adjusted to accommodate variable distances separating the fasteners. The rotary tool can include a first arm and a second arm pivotally coupled to one another at a joint. Ends of the first and second arms are positionable at a variable distance from one another by pivoting the first and second arms at the joint. The rotary tool can also include a first rotatable driver disposed at the end of the first arm, a second rotatable driver disposed at the end of the second arm, and a third rotatable driver disposed at the joint. In addition, the rotary tool can include a drive train operably coupled to the first, second, and third rotatable drivers to transfer torque, such that an input torque applied to one of the first, second, and third rotatable drivers causes torque output at the other rotatable drivers.

A rotary tool system is also disclosed. The rotary tool system can include a rotatable object and a rotary tool to apply torque to the rotatable object. The rotary tool can include a first arm and a second arm pivotally coupled to one another at a joint, wherein ends of the first and second arms are positionable at a variable distance from one another by pivoting the first and second arms at the joint. The rotary tool can also include a first rotatable driver disposed at the end of the first arm, a second rotatable driver disposed at the end of the second arm, and a third rotatable driver disposed at the joint. In addition, the rotary tool can include a drive train operably coupled to the first, second, and third rotatable drivers to transfer torque, such that an input torque applied to one of the first, second, and third rotatable drivers causes torque output at the other rotatable drivers.

Figure 1B:
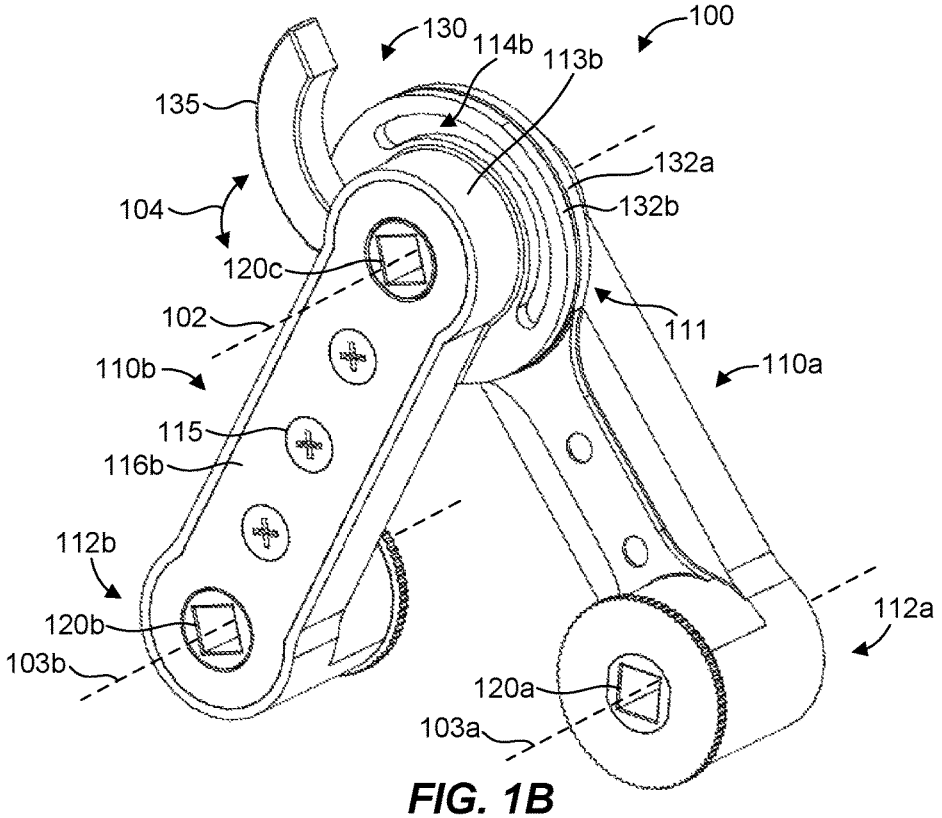
FIG. 1B is an illustration of an opposite side of the rotary tool of FIG. 1A.

One example of a rotary tool 100 is illustrated in FIGS. 1A and 1B, which illustrate opposite sides of the rotary tool 100. The rotary tool 100 can comprise arms 110*a*, 110*b* pivotally coupled to one another at a joint or elbow 111. As described in more detail below, ends 112*a*, 112*b* of the arms 110*a*, 110*b*, respectively, are positionable at a variable distance from one another by pivoting the arms 110*a*, 110*b* at the joint 111. The rotary tool 100 can also include a rotatable driver 120*a* disposed at the end 112*a* of the arm 110*a*, a rotatable driver 120*b* disposed at the end 112*b* of the arm 110*b*, and a rotatable driver 120*c* disposed at the joint 111. In one aspect, the joint 111 can define a pivot axis 102 and at least one of the rotatable drivers 120*a-c* can be rotatable about axes parallel to the pivot axis 102. For example, the rotatable driver 120*c* can be configured to rotate about an axis that is coaxial with the pivot axis 102, and the rotatable drivers 120*a*, 120*b* can be rotatable about axes 103*a*, 103*b*, respectively, which can be parallel to the pivot axis 102. In addition, the rotary tool 100 can include a drive train (obscured from view in these figures) operably coupled to the rotatable drivers 120*a-c* to transfer torque, such that an input torque applied to one of the rotatable drivers 120*a-c* causes torque output at the other rotatable drivers.

The rotatable drivers 120*a-c* can be configured to interface directly with a rotatable object (e.g., a fastener or torque input device, such as a wrench) and/or with a detachable adapter (e.g., a socket, extension, or bit) for interfacing with a rotatable object. For example, the rotatable drivers 120*a-c* can include a recess (e.g., a socket) or a protrusion (e.g., a shank) to interface with a rotatable object. The rotatable drivers 120*a-c* as illustrated have square cross-section interfaces that are recessed within the drivers. It should be recognized, however, that such interfaces can be of any suitable shape or configuration, such as a hexagonal cross-section (recessed or a protruding shank) (i.e., an Allen key configuration), star cross-section, or others. In addition, the rotatable drivers 120*a-c* can comprise different interface types within the same rotary tool. In some examples, this can be accomplished by configuring one or more rotatable drivers differently, or by using adapters or interchangeable drivers.

The rotatable drivers 120*a-c* can be configured to interface with any suitable torque input device (e.g., wrench), driven object (e.g., fastener), and/or an adapter for such. For example, any of the rotatable drivers 120*a-c* can be configured to interface with any device or mechanism for applying torque, such as any suitable hand tool (e.g., a ratchet, a torque wrench, etc.) or power tool (e.g., a drill, impact wrench, etc.). In addition, any of the rotatable drivers 120*a-c* can be configured to interface with any object to be rotated or "torqued" by the tool 100, such as a fastener (e.g., a hexagonal head bolt, an Allen head bolt, a Phillips head screw, a flat head screw, etc.) and/or an adapter (e.g., a socket or a bit) for interfacing with a fastener. Thus, the rotary tool 100 can be used to transfer torque from a torque input device to another rotatable object in a wide range of applications. It should also be recognized that the size of the rotary tool 100 can be scaled to adapt to any suitable dimension for a given application. In one aspect, the rotatable drivers 120*a-c* can be configured to interface with rotatable objects on opposite sides of the tool 100, as illustrated in FIGS. 1A and 1B. In another aspect, one or more of the rotatable drivers 120*a-c* can comprise a ratcheting mechanism 121, such as is typically found in ratcheting hand wrenches, and can therefore be reversible in ratcheting direction.

In one aspect, the rotary tool 100 can include a locking mechanism 130 configured to lock a position of the arms 110*a*, 110*b* relative to one another, which can maintain a desired angle between the arms 110*a*, 110*b* or distance between the rotatable drivers 120*a*, 120*b* during use of the tool 100. The locking mechanism 130 can include a clamp 131 that binds the arms 110*a*, 110*b*. For example, arms 110*a*, 110*b* can include flanges 132*a*, 132*b*, respectively. The clamp 131 can include a fastener 133 (e.g., a threaded stud) extending through at least one of the flanges 132*a*, 132*b* of the arms 110*a*, 110*b*. The fastener 133 can thread into a nut 134, and can be rotated by a lever 135 to which the fastener 133 is coupled. The thread pitch of the fastener 134 and/or the amount of rotation in direction 104 provided for the lever 135 can be configured to facilitate locking the arms 110*a*, 110*b* relative to one another when the lever 135 is in a locked position (FIG. 1A), and to facilitate relative rotation of the arms 110*a*, 110*b* about the axis 102 when the lever 135 is in an unlocked position (FIG. 1B). The nut 134 can be prevented from rotating in any suitable manner, such as by bearing against a side 113*a* of the arm 110*a*, to facilitate locking and unlocking the arms 110*a*, 110*b*. The nut 134 and/or the lever 135 can also be configured to slide in a direction parallel to the axis 102 along the respective sides 113*a*, 113*b* as the lever 135 is rotated to facilitate locking and unlocking the arms 110*a*, 110*b*. In one aspect, the fastener 133 can extend through an opening (obscured from view) in the flange 132*b* sufficient to allow free rotation of the fastener 133 in the opening. The lever 134 can rotate with the arm 110*b* as the arms 110*a*, 110*b* are rotated relative to one another about the axis 102. On the other hand, the flange 113*a* can include an opening 114*a* configured as a channel to facilitate movement of the fastener 133 within the channel opening 114*a* as the arms 110*a*, 110*b* are rotated relative to one another about the axis 102. The nut 134 can therefore slide around the end or side 113*a* of the arm 110*a* as the arms 110*a*, 110*b* are rotated relative to one another. In one aspect, the arms 110*a*, 110*b* can be substantially identical, which can reduce manufacturing costs. Thus, as illustrated in FIG. 1B, the arm 110*b* can include a channel opening 114*b* in the flange 132*b* which is not utilized. Similarly, the arm 110*a* can include an opening (obscured from view) in the flange 132*a* to allow free rotation of the fastener, which is not utilized.

Figure 2:
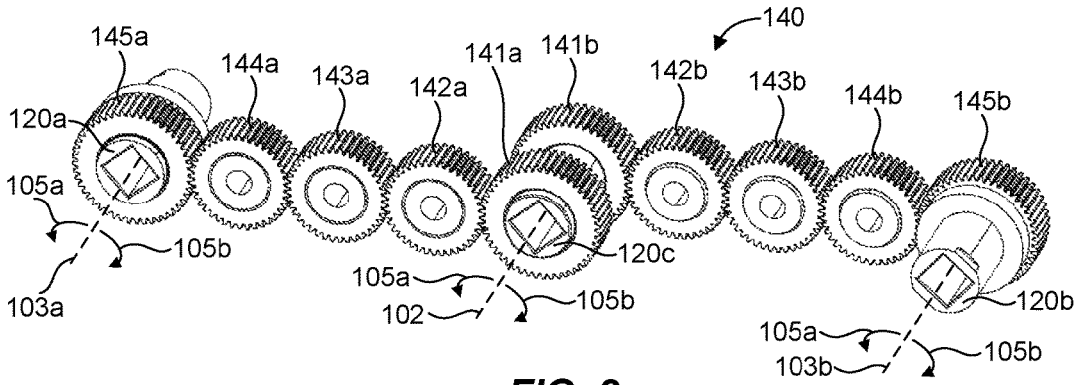
FIG. 2 is an example illustration of a drive train of the rotary tool of FIGS. 1A and 1B, in accordance with an example of the present disclosure.

FIG. 2 illustrates a drive train 140 that can be included in the rotary tool 100 of FIGS. 1A and 1B. In this case, the drive train 140 comprises a gear train. The gear train can include gears 141*a*-145*a*, which can be included in the arm 110*a*. The gear train can also include gears 141*b*-145*b*, which can be included in the arm 110*b*. The rotatable driver 120*c* can be coupled to the gears 141*a*, 141*b* such that the gears rotate together with the rotatable driver 120*c*. The rotatable drivers 120*a*, 120*b* can be coupled to the gears 145*a*, 145*b*, respectively, such that the gears 145*a*, 145*b* rotate together with the respective rotatable drivers 120*a*, 120*b*. The intermediate gears 142*a*-144*a* can couple the gears 141*a* and 145*a* to one another for the transmission of torque. Similarly, the intermediate gears 142*b*-144*b* can couple the gears 141*b* and 145*b* to one another for the transmission of torque. Any suitable number of intermediate gears can be utilized. For example, a greater number and/or diameter of gears can be utilized to accommodate a greater distance between the rotatable drivers 120*a* and 120*c* and/or between the rotatable drivers 120*b* and 120*c*. Fasteners 115 (see FIGS. 1A and 1B) can maintain rotational axes for the intermediate gears and/or secure a tool housing or cover 116*a*, 116*b* about the drive train 140.

In one aspect, the drive train 140 can be configured such that the rotatable drivers 120*a-c* rotate simultaneously in the same direction. For example, the number of intermediate gears between the rotatable drivers 120*a* and 120*c* and between the rotatable drivers 120*b* and 120*c* can be such that rotation of any one of the rotatable drivers 120*a-c* will simultaneously cause rotation of the other rotatable drivers in the same direction. As illustrated in FIG. 2, rotation of the rotatable driver 120*c* in direction 105*a* about the axis 102 will cause rotation of the rotatable drivers 120*a*, 120*b* in direction 105*a* about the axes 103*a*, 103*b*, respectively. On the other hand, rotation of the rotatable driver 120*c* in direction 105*b* about the axis 102 will cause rotation of the rotatable drivers 120*a*, 120*b* in direction 105*b* about the axes 103*a*, 103*b*, respectively. Similarly, rotation of the rotatable driver 120*a* in direction 105*a* about the axis 103*a* will cause rotation of the rotatable drivers 120*c*, 120*b* in direction 105*a* about the axes 102, 103*b*, respectively, and rotation of the rotatable driver 120*a* in direction 105*b* about the axis 103*a* will cause rotation of the rotatable drivers 120*c*, 120*b* in direction 105*b* about the axes 102, 103*b*, respectively. Although the drive train illustrated is configured to simultaneously cause rotation of the rotatable drivers in the same direction, it should be recognized that a drive train can be configured to simultaneously cause rotation of one or more rotatable drivers in different directions. It should also be recognized that any suitable type of drive train can be utilized, or a combination of these. For example, the drive train can include a gear, a belt, a chain, a kinematic mechanism, or any other suitable drive train component or mechanism known in the art.

Figure 3:
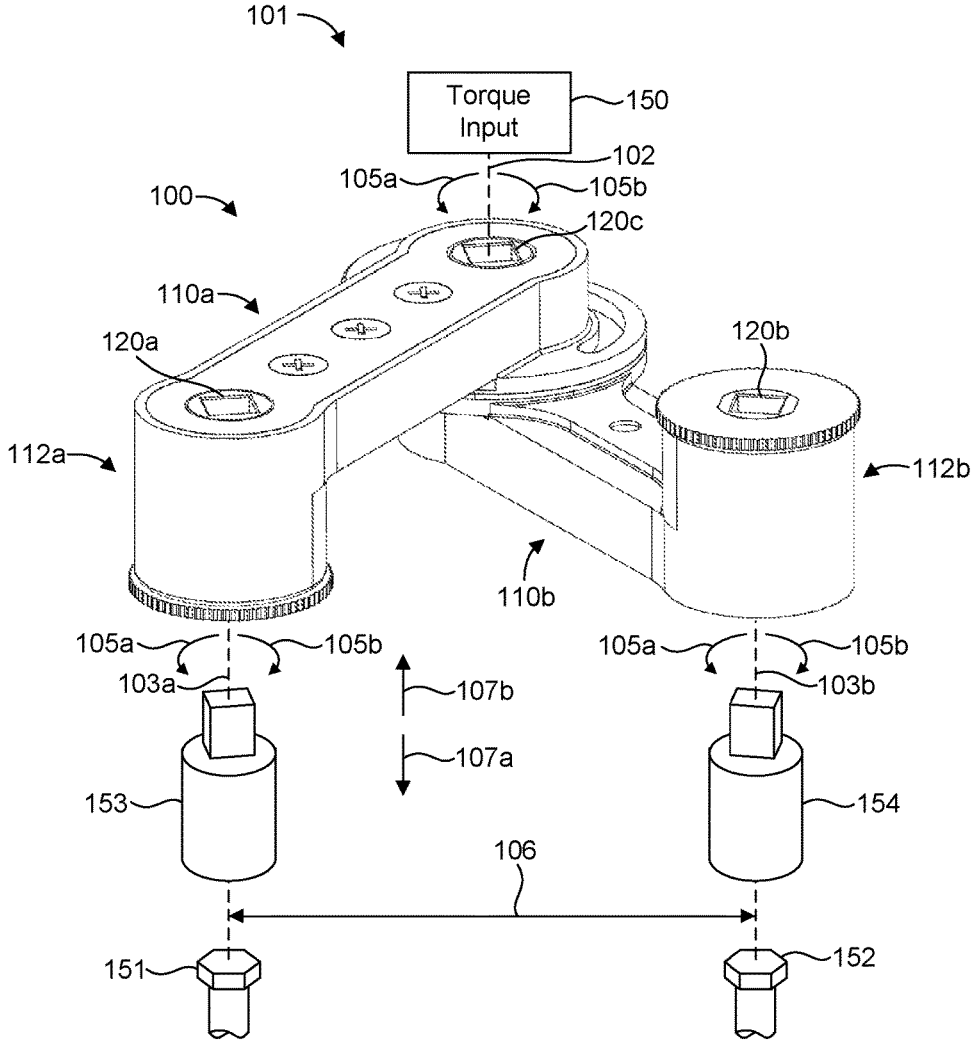
FIG. 3 is an example illustration of a rotary tool system that includes the rotary tool of FIGS. 1A and 1B, in accordance with an example of the present disclosure.

FIG. 3 illustrates a rotary tool system 101 in accordance with an example of the present disclosure that includes the rotary tool 100 discussed above. The system 100 can also include one or more rotatable objects, such as a torque input device 150 and one or more objects 151, 152 to be rotated or torqued. The torque input device 150 can provide a torque and the rotary tool 100 can apply the torque to one or more of the rotatable objects 151, 152. For example, the torque input device 150 can apply torque to one of the rotatable drivers and thereby apply torque to one or more of the rotatable objects 151, 152 when engaged with one or more of the other rotatable drivers. In the illustrated example, the torque input device 150 is configured to apply torque to the rotatable driver 120*c*, and the rotatable drivers 120*a*, 120*b* are configured to engage the rotatable objects 151, 152, respectively.

In one aspect, the system 101 can include one or more detachable adapters 153, 154 for interfacing with one or more of the rotatable drivers 120*a-c* and one or more of the rotatable objects 150-152. In this case, the detachable adapters 153, 154 are configured to adapt the rotatable drivers 120*a*, 120*b* for engagement with the rotatable objects 151, 152. The detachable adapters 153, 154 can include any suitable feature or configuration known in the art for interfacing with two components (e.g., a rotatable driver interface and a wrench or fastener head), such as a protrusion (e.g., a shank), a recess, (e.g., a socket), etc. In one aspect, the detachable adapters 153, 154 can comprise extension members to accommodate a distance parallel to the axes 103*a*, 103*b* between the rotatable drivers and respective rotatable objects.

Figure 4A:
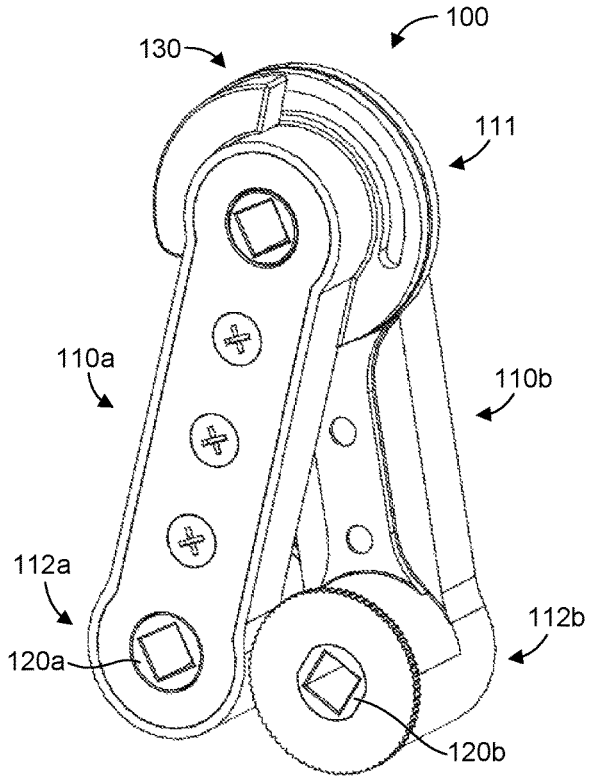
FIG. 4A illustrates a minimized span between rotatable drivers of the rotary tool of FIGS. 1A and 1B, in accordance with an example of the present disclosure.
Figure 4B:
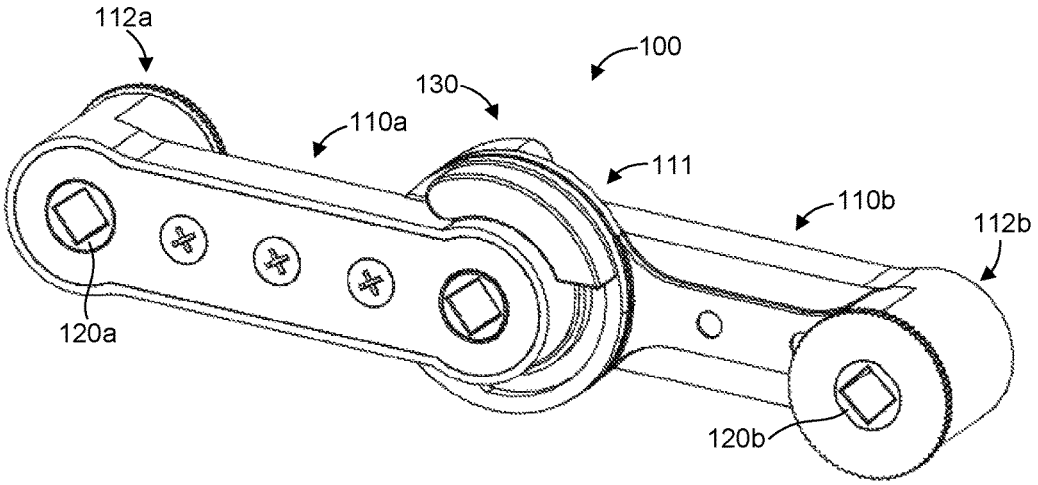
FIG. 4B illustrates a maximized span between rotatable drivers of the rotary tool of FIGS. 1A and 1B, in accordance with an example of the present disclosure.

As mentioned above, the torque input device 150 can be any suitable power and/or hand tool configured to generate or produce torque, and the rotatable objects 151, 152 can be any suitable object to be rotated or torqued (e.g., a fastener). In one example, the rotatable objects 151, 152 can be threaded posts for specialized connectors (e.g., for electronic components), where the posts are tightly constrained by a connector body or housing. In such connectors, advancing or retracting one post too much relative to the other post can cause the posts to bind within the connector body, which may cause damage to the connector body and/or the posts. In circumstances such as this it can be desirable to rotate or apply torque to two rotatable objects simultaneously, thereby causing the rotatable objects to advance or retract in unison, which can prevent binding or damage to the rotatable objects and/or associated components. For example, the rotatable objects 151, 152 can be separated from one another by a separation distance 106. The ends 112*a*, 112*b* of the arms 110*a*, 110*b*, respectively, can be positionable from one another at the separation distance 106 to simultaneously engage the rotatable drivers 120*a*, 120*b* with the rotatable objects 151, 152. The separation distance 106 can be variable depending on the particular rotatable object configuration. To accommodate such a variable separation distance, the respective ends 112*a*, 112*b* of arms 110*a*, 110*b* can be positionable at a variable distance from one another by pivoting the arms 110*a*, 110*b* at the joint 111. The distance or span between the ends 112*a*. 112*b*, and therefore the distance or span between the rotatable drivers 120*a*, 120*b*, can be minimized (as shown in FIG. 4A) and maximized (as shown in FIG. 4B). Unlocking the locking mechanism 130, as discussed above, can facilitate achieving a desired distance between the rotatable drivers 120*a*, 120*b*. Once a desired spacing between the rotatable drivers 120*a*, 120*b* has been achieved, the relative position of the arms 110*a*, 110*b* (e.g., an angle between the arms 110*a*, 110*b*) can be locked utilizing the locking mechanism 130, as discussed above.

In one aspect, the torque input device 150 can apply torque to the rotatable driver 120*c* and thereby simultaneously apply torque to the rotatable objects 151, 152 when engaged with the rotatable drivers 120*a*, 120*b*. For example, the torque input device 150 can apply torque to the rotatable driver 120*c* in direction 105*a*, which can cause the rotatable drivers 120*a*, 120*b* to apply torque in direction 105*a* to the rotatable objects 151, 152, respectively. Similarly, the torque input device 150 can apply torque to the rotatable driver 120*c* in the reverse direction 105*b*, which can cause the rotatable drivers 120*a*, 120*b* to apply torque in the reverse direction 105*b* to the rotatable objects 151, 152, respectively. Thus, utilizing the rotary tool 100, two rotatable objects 151, 152 can be simultaneously rotated or torqued with a single torque input device 150.

Figure 5:
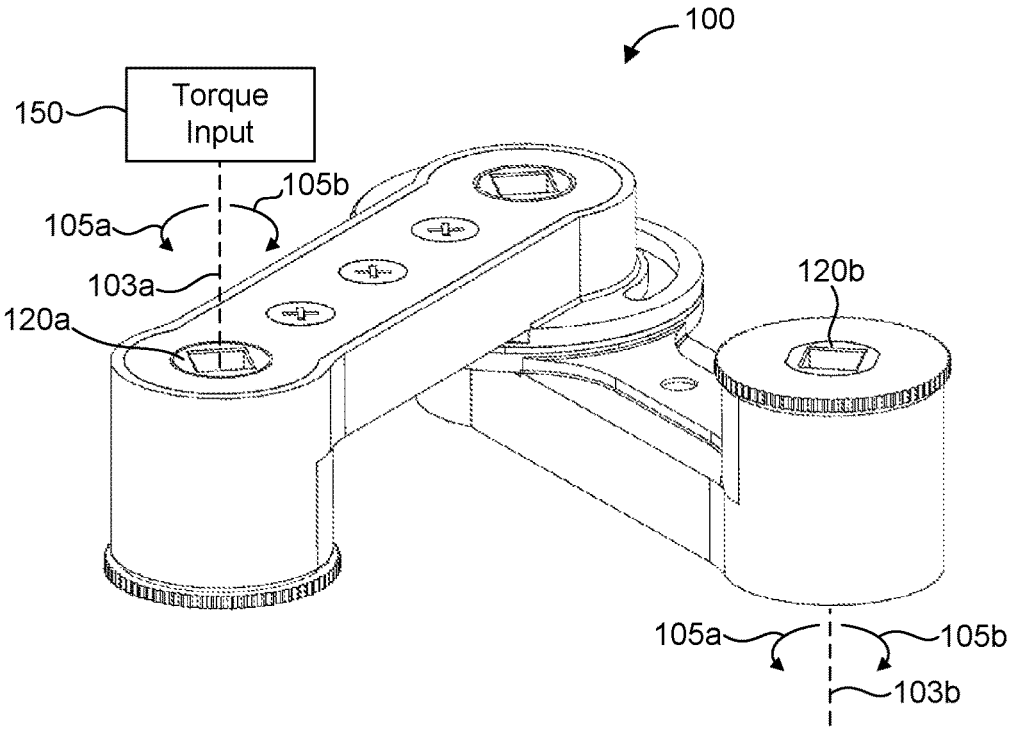
FIG. 5 illustrates an alternate use of the rotary tool of FIGS. 1A and 1B, in accordance with an example of the present disclosure.

An alternative use of the rotary tool 100 is illustrated in FIG. 5. In this case, the torque input device 150 can apply torque to the rotatable driver 120*a* in direction 105*a* about the axis 103*a*, which will cause rotation of the rotatable driver 120*b* in direction 105*a* about the axis 103*b*. Similarly, the torque input device 150 can apply torque to the rotatable driver 120*a* in direction 105*b* about the axis 103*a*, which will cause rotation of the rotatable driver 120*b* in direction 105*b* about the axis 103*b*. In this way a rotatable driver (e.g., the rotatable driver 120*a* in this case) at an end of the rotary tool 100 can be used as the torque or drive input, which can allow the rotatable driver (e.g., the rotatable driver 120*b* in this case) at an opposite end of the tool 100 to reach difficult locations, such as in hard to reach areas or around a corner.

Figure 6:
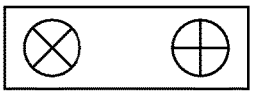
FIG. 6 illustrates fastener interface features represented as angularly misaligned for proper engagement with mating interface features of rotatable drivers of the rotary tool of FIGS. 1A and 1B, in accordance with an example of the present disclosure.

With further reference to FIGS. 1A-4B, in some situations interface features of rotatable objects (e.g., fasteners) may be misaligned relative to an orientation of mating interface features (e.g., sockets or shanks) of the rotatable drivers (e.g., rotatable drivers 120*a*, 120*b*) and/or adapters (e.g., adapters 153, 154). For fasteners this is illustrated in FIG. 6, where Phillips head interface features are represented as angularly misaligned for proper engagement with mating Phillips head driver interface features of rotatable drivers and/or adapters. Because the rotatable drivers 120*a-c* are coupled to one another via the drive train 140, relative rotation of the rotatable drivers 120*a-c* may not be possible while one or more of the rotatable drivers 120*a-c* are engaged with the drive train 140.

Figure 7A:
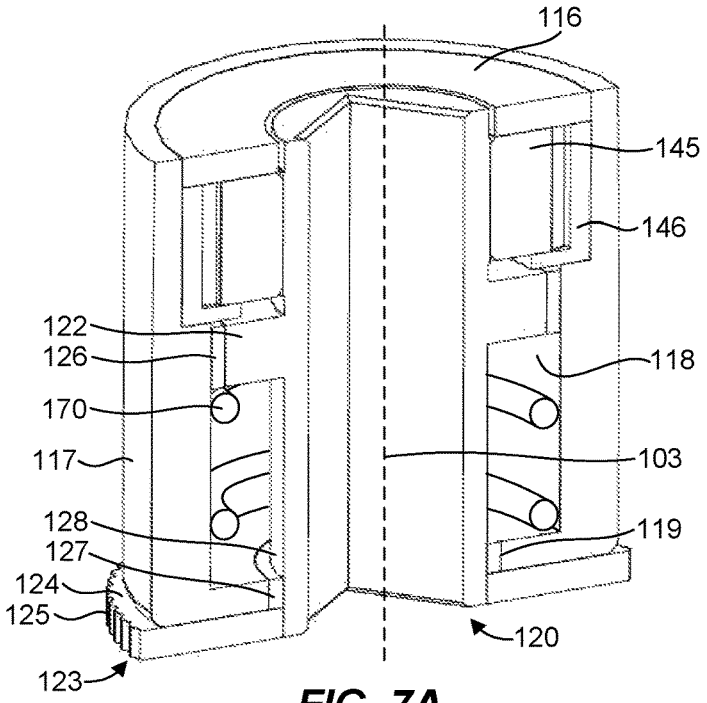
FIG. 7A illustrates a cross-sectional view of a rotatable driver engaged with a drive train of the rotary tool of FIGS. 1A and 1B, in accordance with an example of the present disclosure.
Figure 7B:
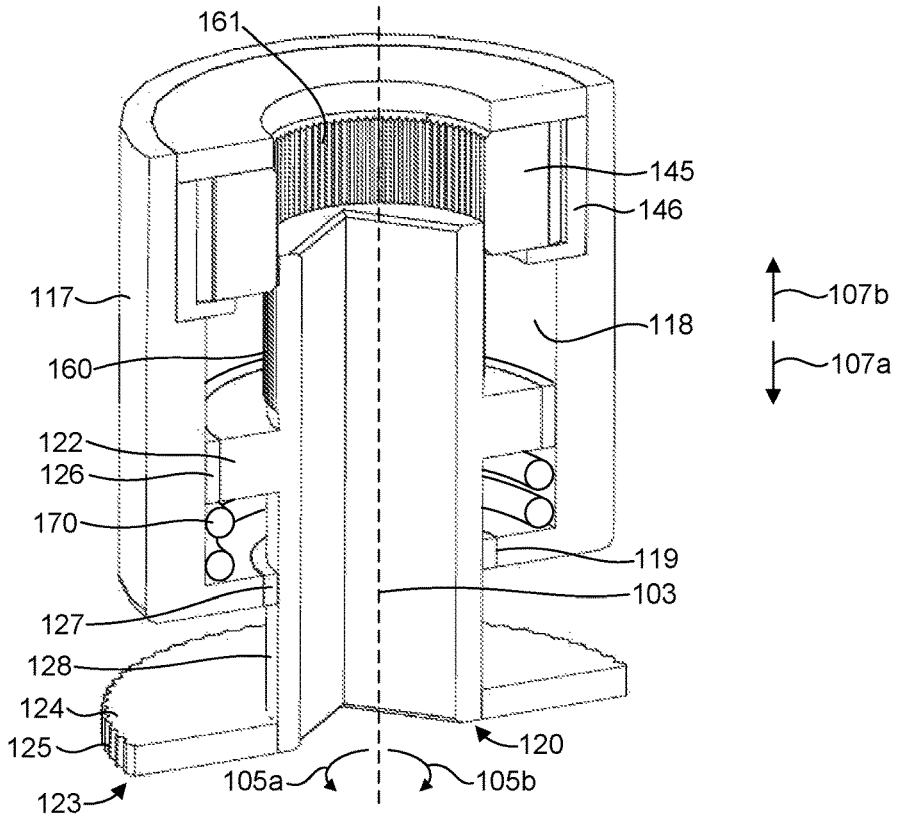
FIG. 7B illustrates a cross-sectional view of a rotatable driver disengaged from a drive train of the rotary tool of FIGS. 1A and 1B, in accordance with an example of the present disclosure.

Accordingly, the rotary tool 100 can include features, such as a rotatable driver disengaging mechanism, that enable a rotatable driver to be selectively rotatable independent of another rotatable driver, such as by disengagement from the drive train 140, to facilitate simultaneous engagement of the rotational drivers with multiple rotatable objects. FIGS. 7A and 7B illustrate cross-sectional views of an example, rotatable driver disengaging mechanism comprising rotatable driver 120 that may be representative of any rotatable driver of the rotary tool 100. The features shown in these figures may be particularly beneficial for rotatable drivers 120*a*, 120*b* located at the ends 112*a*, 112*b* of the arms 110*a*, 110*b*, which may be primarily used for engaging with rotatable objects (e.g., fasteners) that are to be driven or rotated by the tool 100 (e.g., as in FIG. 3). The rotatable driver 120 is rotatable in directions 105*a*, 105*b* about a rotational axis 103, and translatable in directions 107*a*, 107*b* parallel to the rotational axis 103 to disengage from the drive train (represented by a gear 145), thereby facilitating selective rotation of the rotatable driver 120 independent of other rotatable drivers.

Thus, in FIG. 3, for example, the rotatable driver 120*a* can be translated or moved in direction 107*a* to disengage from the drive train 140. Once disengaged, the rotatable driver 120*a* can be rotated in direction 105*a* and/or 105*b* as desired to orient the rotatable driver 120*a* and/or the adapter 153 for engagement with the rotatable object 151. Once in proper alignment, the rotatable driver 120*a* can be translated or moved in direction 107*b* to engage the drive train 140. Additionally, or alternatively, the rotatable driver 120*b* can be similarly manipulated for alignment and engagement with the rotatable object 152. Thus, an angular orientation of one or more of the rotatable drivers 120*a*, 120*b* can be individually adjusted to enable alignment and engagement with the rotatable objects 151, 152. The rotary tool 100 can therefore accommodate a variable space or gap 106 between the rotatable objects 151, 152, as well as rotational misalignment between the rotational drivers 120*a*, 120*b* and the rotatable objects 151, 152.

Referring again to FIGS. 7A and 7B, in one aspect, the rotatable driver 120 and the drive train (e.g., the gear 145) can have spline interfaces 160, 161, respectively, that facilitate translation of the rotatable driver 120 to alternately disengage and engage the rotatable driver 120 and the drive train for angular or rotational adjustment as described above. For example, the spline interfaces 160, 161 can be oriented and configured to facilitate translation of the rotatable driver 120 in the direction 107*a* to disengage the rotatable driver 120 from the drive train and in direction 107*b* to engage the rotatable driver 120 with the drive train. The number of spline "teeth" can influence or define the minimum angle of adjustment for the rotatable driver 120 relative to a rotatable object. Thus, in some examples, the spline teeth can enable a highly precise alignment of the rotatable driver 120 and a rotatable object. The spline teeth can also be configured to withstand a suitable amount of torque for a given application.

In one aspect, the rotatable driver 120 can be biased toward an engaged position with the drive train (e.g., the gear 145), such as in direction 107*b*, to prevent unwanted disengagement of the rotatable driver 120 from the drive train, and maintain the rotatable driver 120 in a suitable configuration for applying torque to a rotatable object. For example, a spring 170 can be configured to act against a flange or shoulder 122 of the rotatable driver 120 tending to force the rotatable driver 120 in the direction 107*b* into engagement with the gear 145. The spring 170 and the flange or shoulder 122 are shown located internal to the rotary tool 100, although other configurations are possible.

In one aspect, the rotatable driver 120 can include a user interface portion 123 to facilitate moving the rotatable driver 120 in the direction 107*a* to disengage from the drive train. For example, the user interface portion 123 can have a tab 124 that extends beyond an outer surface 117 (e.g., a surface of the arm 110*a* or 110*b*) to facilitate interfacing with a user's fingers to withdraw the rotatable driver 120 from engagement with the drive train. The user interface portion 123 can also include friction enhancing features 125 (e.g., knurling, grooves, etc.) to facilitate rotation of the rotatable driver 120 in directions 105*a*, 105*b* for adjusting the angular position of the rotatable driver 120 when disengaged from the drive train.

Bushings or bearings 126, 127 can be included to facilitate translation in directions 107*a*, 107*b* and/or rotation in directions 105*a*, 105*b* of the rotatable driver 120 as described herein. For example, the bushings or bearings 126 can be configured to interface with the flange or shoulder 122 and an inner wall 118. The bushings or bearings 127 can be configured to interface with an outer surface 128 of the rotatable driver 120 and an opening surface 119 through which the rotatable driver 120 can move or extend. In addition, a bushing or bearing 146 can be disposed about a portion of the gear 145 to facilitate rotation of the gear 145. A cover 116 can protect the gear 145 and maintain the gear 145 in place. The cover 116 can also provide for access to the rotary driver 120 from an end opposite the location of the user interface portion 123.

Figure 8:
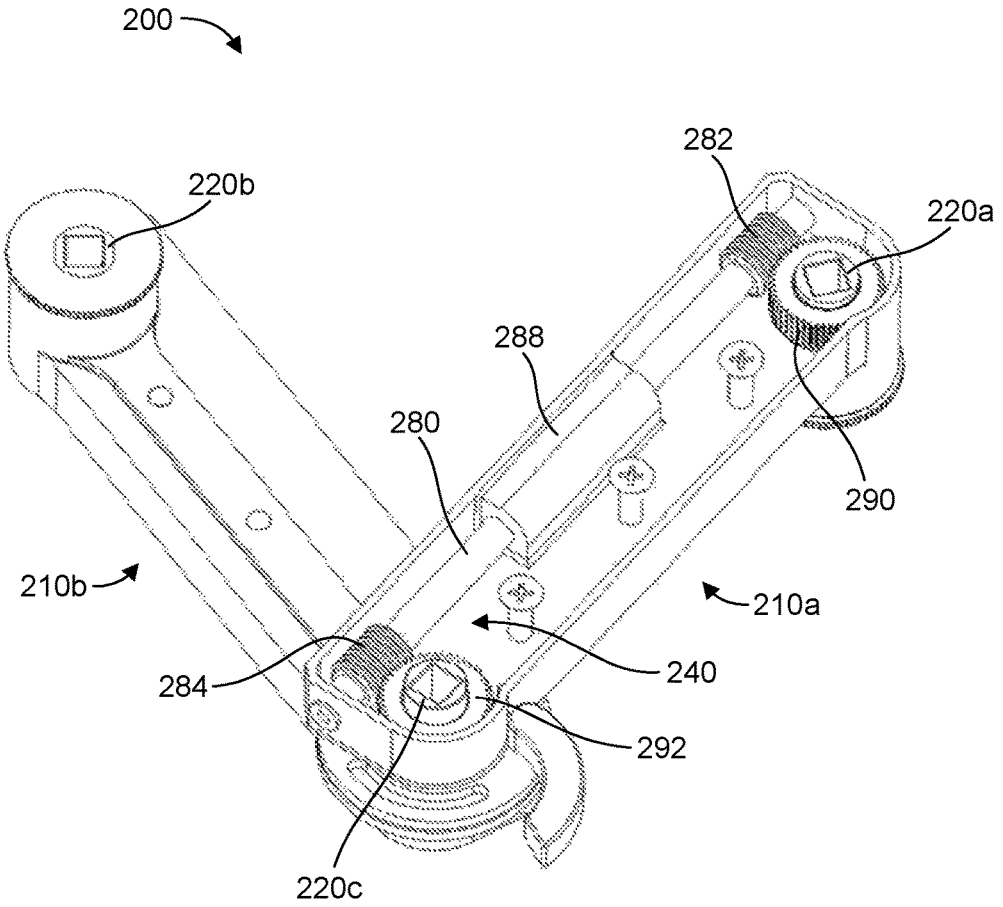
FIG. 8 illustrates a rotary tool in accordance with another example of the present disclosure.

As discussed above, the drive train can include gears, bevel gears, belts, chains, kinematic mechanisms, or any other suitable drive train component or mechanism. In some cases, it may be impractical to use conventional gears as discussed above, such as when the length of the arms make it impractical to do so. FIG. 8 illustrates a rotary tool in accordance with another example. The rotary tool 200 comprises many similar components and functions in a similar manner as the rotary tools discussed above, and as such, the discussion above is incorporated here where applicable, as will be apparent to those skilled in the art. However, unlike the rotary tools discussed above, the rotary tool 200 comprises a different type of drive train. Specifically, the rotary tool 200 comprises a drive train supported within the arm 210*a* utilizing a worm type of drive train, wherein the force can be transferred using worm gears. In this example, a worm shaft 280 can be supported about the first arm 210*a* via a retainer 288, and can comprise first and second worm gears 282, 284 located at opposing ends of the worm shaft 280, that engage corresponding or respective worm wheels 290, 292 (similar to a spur gear or helical spur gears). The worm wheels 290, 292 can be operatively coupled to respective rotatable drivers 220*a*, 220*c*, such that the worm wheels 290, 292 rotate together with the rotatable drivers 220*a*, 220*c* for the transmission of torque. Although not shown, a similar worm gear arrangement can be included in the second arm 210*b*, operative with rotatable drivers 220*b*, 220*c*.

Figure 9:
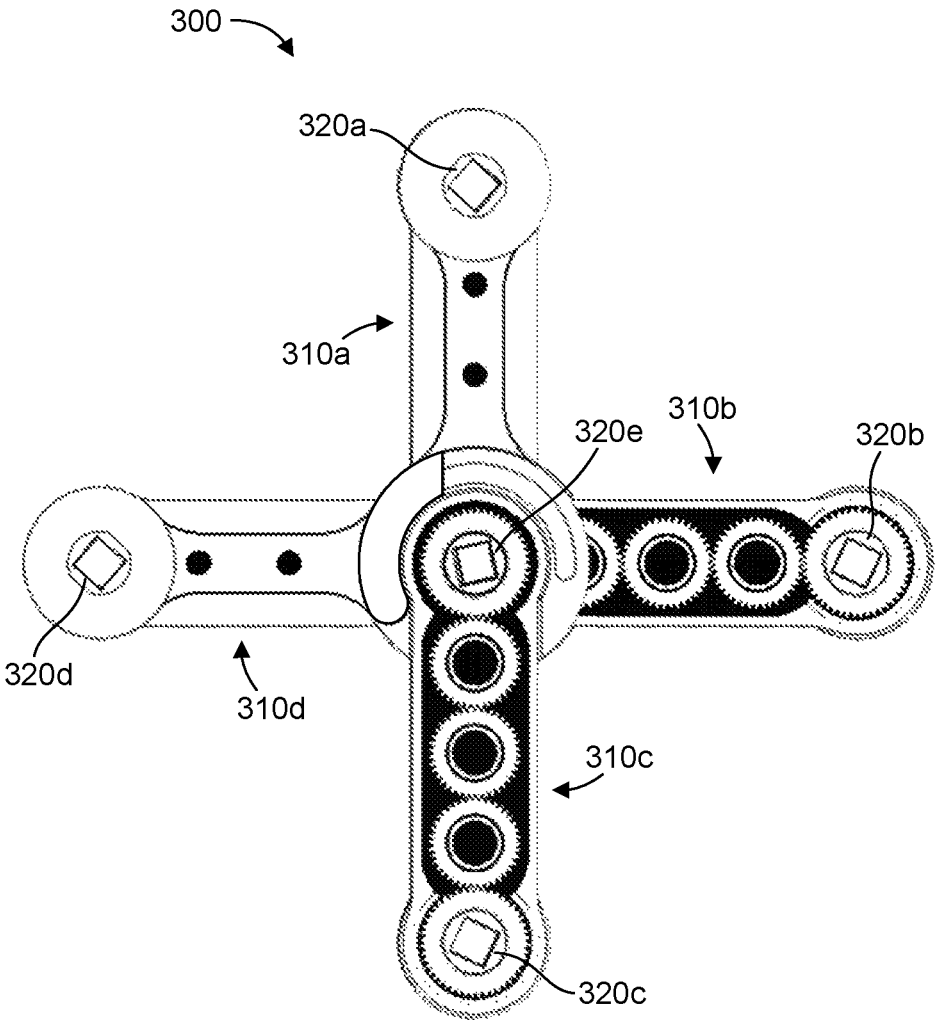
FIG. 9 illustrates a rotary tool in accordance with another example of the present disclosure.

Referring generally to FIGS. 1A-1B, it should be recognized that a rotary tool as disclosed herein can include any suitable number of arms. Thus, although the rotary tool 100 is shown with two arms 110*a*, 110*b*, a rotary tool in accordance with the present disclosure can include any suitable number of two or more arms, wherein the input gear is capable of driving multiple output arms. Such arms can be pivotally connected end-to-end at joints and can provide any suitable number of rotatable drivers, which can be located at the joints and ends of the arms. A drive train can couple the rotatable drivers such that torque can be transferred between the rotatable drivers. Thus, the concepts and principles shown and described with respect to the illustrated examples can be extended to include any number of arms and rotatable drivers, which may be limited only by practical considerations, such as size and need for a given application. FIG. 9 illustrates a rotary tool 300 in accordance with another example of the present disclosure, in which the rotary tool 300 comprises four simultaneously functioning arms 320*a-d* operative with rotatable drivers 320*a-d*, respectively, as well as rotatable driver 320-*e*. FIG. 9 illustrates the rotary tool 300 having the top cover removed from the arms 310*b* and 310*c* in order to illustrate the example drive train in the form of a gear system similarly configured and operable as the drive system of FIGS. 1A-1B. The rotary tool 300 comprises many similar components and functions in a similar manner as the rotary tools discussed above, and as such, the discussion above is incorporated here where applicable, as will be apparent to those skilled in the art.

In accordance with one embodiment of the present invention, a method for facilitating simultaneous application of torque to two rotatable objects is disclosed. The method can comprise providing a rotary tool having a first arm and a second arm pivotally coupled to one another at a joint, wherein the ends of the first and second arms are positionable at a variable distance from one another by pivoting the first and second arms at the joint, a first rotatable driver disposed at an end of the first arm, a second rotatable driver disposed at an end of the second arm, and a third rotatable driver disposed at the joint. Additionally, the method can comprise facilitating torque transfer between the first, second, and third rotatable drivers, such that an input torque applied to one of the first, second, and third rotatable drivers causes torque output at the other rotatable drivers. In one aspect, facilitating torque transfer between the first, second, and third rotatable drivers can comprise providing a drive train operably coupled to the first, second, and third rotatable drivers to transfer torque. It is noted that no specific order is required in this method, though generally in one embodiment, these method steps can be carried out sequentially.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A rotary tool, comprising:

a first arm and a second arm pivotally coupled to one another at a joint, wherein ends of the first and second arms are positionable at a variable distance from one another by pivoting the first and second arms at the joint;

a first rotatable driver disposed at the end of the first arm;

a second rotatable driver disposed at the end of the second arm;

a third rotatable driver disposed at the joint; and a drive train operably coupled to the first, second, and third rotatable drivers to transfer torque, such that an input torque applied to one of the first, second, and third rotatable drivers causes torque output at the other rotatable drivers, a rotatable driver disengaging mechanism operable to disengage at least one of the first, second or third rotatable drivers from the drive train, wherein at least one of the first, second or third rotatable drivers is selectively rotatable independent of the other of the first, second or third rotatable drivers.

2. The rotary tool of claim 1, wherein the joint defines a pivot axis and at least one of the first, second, and third rotatable drivers are rotatable about axes parallel to the pivot axis.

3. The rotary tool of claim 1, wherein the drive train is selected from a gear-type drive train, a belt type drive train, a chain type drive train, and any combination of these.

4. The rotary tool of claim 1, wherein the drive train is configured such that the first, second, and third rotatable drivers rotate simultaneously in the same direction.

5. The rotary tool of claim 1, wherein the first rotatable driver is selectively rotatable independent of the second and third rotatable drivers to facilitate simultaneous engagement of the first and second drivers with two rotatable objects.

6. The rotary tool of claim 5, wherein the first rotatable driver is rotatable about a first rotational axis, and translatable in a direction parallel to the first rotational axis to disengage from the drive train, thereby facilitating selective rotation independent of the second and third rotatable drivers.

7. The rotary tool of claim 6, wherein the first rotatable driver is biased toward an engaged position with the drive train.

8. The rotary tool of claim 6, wherein each of the first rotatable driver and the drive train comprise a spline interface that facilitates translation of the first rotatable driver in the direction parallel to the first rotational axis to disengage the first rotatable driver from the drive train.

9. The rotary tool of claim 1, wherein at least one of the first, second, and third rotatable drivers comprises a socket.

10. The rotary tool of claim 1, wherein at least one of the first, second, and third rotatable drivers comprises a shank.

11. The rotary tool of claim 1, wherein at least one of the first, second, and third rotatable drivers comprises a ratcheting mechanism.

12. The rotary tool of claim 1, further comprising a locking mechanism configured to lock a position of the first arm and the second arm relative to one another.

13. The rotary tool of claim 12, wherein the locking mechanism comprises a clamp that binds the first and second arms.

14. The rotary tool of claim 13, wherein the clamp comprises a fastener extending through at least one flange of the first and second arms.

15. A rotary tool system, comprising:

a rotatable object; and a rotary tool to apply torque to the rotatable object, the rotary tool having a first arm and a second arm pivotally coupled to one another at a joint, wherein ends of the first and second arms are positionable at a variable distance from one another by pivoting the first and second arms at the joint, a first rotatable driver disposed at the end of the first arm, a second rotatable driver disposed at the end of the second arm, a third rotatable driver disposed at the joint, and a drive train operably coupled to the first, second, and third rotatable drivers to transfer torque, such that an input torque applied to one of the first, second, and third rotatable drivers causes torque output at the other rotatable drivers, a rotatable driver disengaging mechanism operable to disengage at least one of the first, second or third rotatable drivers from the drive train, wherein at least one of the first, second or third rotatable drivers is selectively rotatable independent of the other of the first, second or third rotatable drivers.

16. The system of claim 15, further comprising a torque input device to apply torque to one of the first, second, and third rotatable drivers and thereby apply torque to the rotatable object when engaged with one of the other rotatable drivers.

17. The system of claim 16, further comprising a second rotatable object separated from the first rotatable object by a separation distance, wherein the ends of the first and second arms are positionable from one another at the separation distance to simultaneously engage the first and second rotatable drivers with the first and second rotatable objects, and wherein the torque input device applies torque to the third rotatable driver and thereby applies torque to the first and second rotatable objects when engaged with the first and second rotatable drivers.

18. The system of claim 16, wherein the torque input device comprises a power tool, a hand tool, or a combination thereof.

19. The system of claim 15, further comprising a detachable adapter for interfacing with at least one of the first, second, and third rotatable drivers and the rotatable object.

20. A method for facilitating simultaneous application of torque to two rotatable objects, comprising:

providing a rotary tool having a first arm and a second arm pivotally coupled to one another at a joint, wherein ends of the first and second arms are positionable at a variable distance from one another by pivoting the first and second arms at the joint, a first rotatable driver disposed at the end of the first arm, a second rotatable driver disposed at the end of the second arm, a third rotatable driver disposed at the joint, and a rotatable driver disengaging mechanism that facilitates selective rotation of at least one of the first, second or third rotatable drivers independent of the other of the first, second or third rotatable drivers; and facilitating torque transfer between the first, second, and third rotatable drivers, such that an input torque applied to one of the first, second, and third rotatable drivers causes torque output at the other rotatable drivers.

21. The method of claim 20, wherein facilitating torque transfer between the first, second, and third rotatable drivers comprises providing a drive train operably coupled to the first, second, and third rotatable drivers to transfer torque, wherein the rotatable driver disengaging mechanism is operable to disengage at least one of the first, second or third rotatable drivers from the drive train.

* * * * *